US005889874A

United States Patent [19]

Schmitt et al.

[11] Patent Number: 5,889,874

[45] Date of Patent: Mar. 30, 1999

[54] HEARING AID DEVICE TO BE WORN IN THE EAR

[75] Inventors: Christian Schmitt, Grossenseebach; Joseph Sauer, Strullendorf, both of Germany

[73] Assignee: Siemens Audiologische Technik GmbH, Erlangen, Germany

[21] Appl. No.: 17,704

[22] Filed: Feb. 3, 1998

[30] Foreign Application Priority Data

Feb. 18, 1997 [DE] Germany ..... 197 06 306.3

[51] Int. Cl.[6] ..... H04R 25/00

[52] U.S. Cl. ..... 381/328; 381/322; 381/324

[58] Field of Search ..... 381/312, 322, 381/328, 23.1, 313, 324, 327; 600/25; 607/56, 57; 181/129, 130, 135

[56] References Cited

U.S. PATENT DOCUMENTS

| | | | |
|---|---|---|---|
| 4,471,490 | 9/1984 | Bellafiore | 381/328 |
| 4,476,353 | 10/1984 | Haertl . | |
| 4,532,649 | 7/1985 | Bellafiore | 381/324 |
| 4,634,815 | 1/1987 | Marquis . | |
| 4,672,672 | 6/1987 | Eggert et al. | 381/328 |
| 4,739,512 | 4/1988 | Hartl et al. . | |

FOREIGN PATENT DOCUMENTS

| | | |
|---|---|---|
| 34 06 972 | 8/1985 | Germany . |
| 87 13 595 | 1/1988 | Germany . |
| 91 02 655 | 8/1991 | Germany . |

*Primary Examiner*—Huyen Le
*Attorney, Agent, or Firm*—Hill & Simpson

[57] ABSTRACT

An ITE hearing aid device has a pre-fabricated face plate which closes a housing shell and which forms a function unit with hearing aid components, the face plate having a closed visible surface without openings and without components placed thereon.

13 Claims, 2 Drawing Sheets

FIG. 1
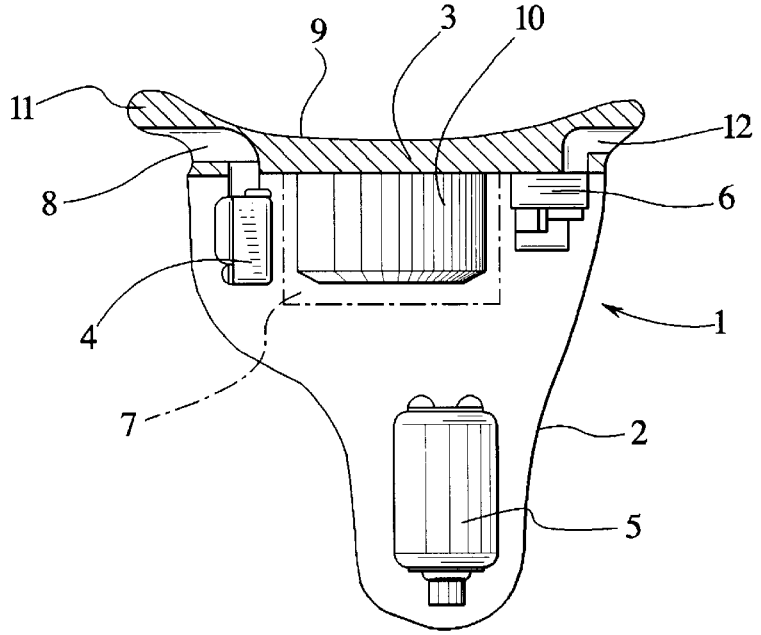
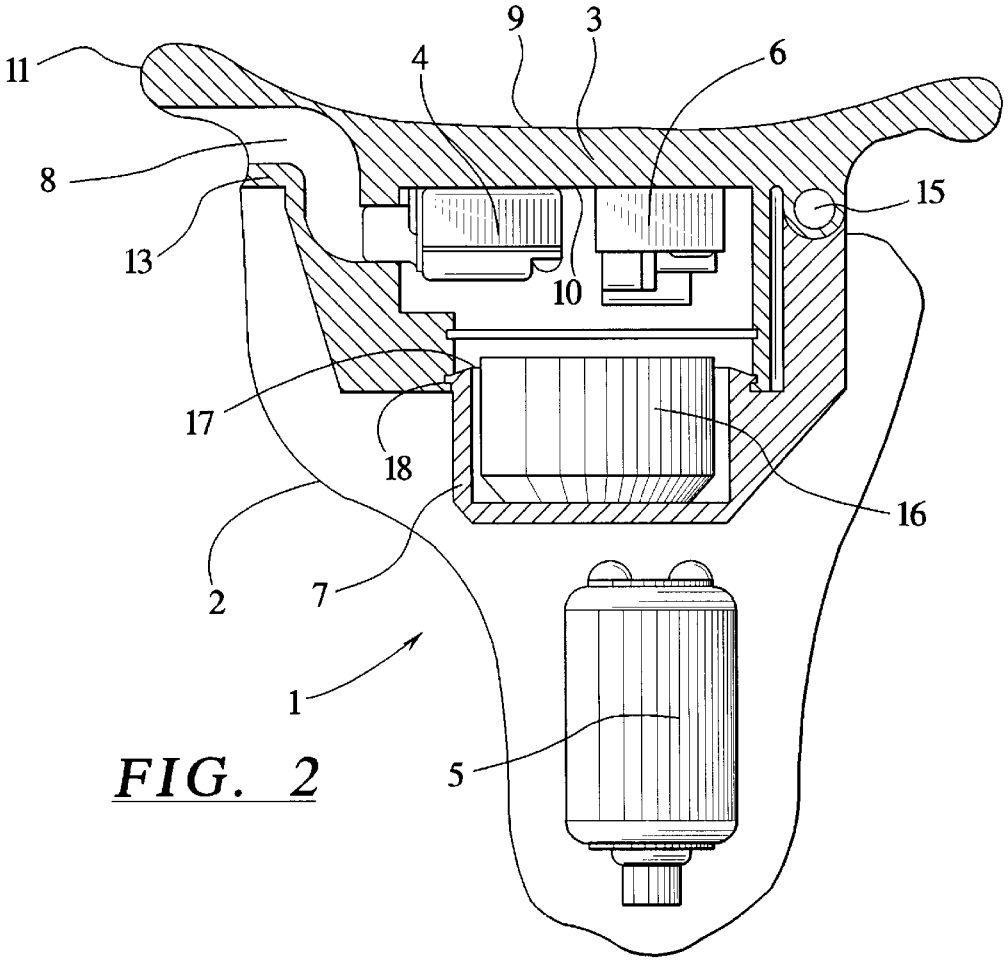
FIG. 2

HEARING AID DEVICE TO BE WORN IN THE EAR

BACKGROUND OF THE INVENTION

1. Field of the Invention

The present invention is directed to a hearing aid device to be worn in the ear, of the type having a housing composed of an individually fabricated shell and a face plate attachable to the shell, with hearing aid components such as a microphone, an earphone, an amplifier unit and a battery compartment being arranged in the housing, and the face plate having a sound admission opening.

2. Description of the Prior Art

German Utility Model G 85 18 681.3 discloses a modular hearing aid device to be worn in the ear having a housing shell insertable into the auditory passage, the shell being closed by a cap-like face plate. The face plate carries actuation elements, such as a volume control, an tone adjustment element and a holder for a battery attached via a shaft. Further, an opening for sound admission to an internal microphone is provided in the face plate, the microphone being situated in the housing under the face plate. The face plate is visible in the auricle with its openings and actuation elements thereon, which is considered to be undesirable by some users.

German Utility Model G 81 06 942.1 discloses a hearing aid of the type known as an in-the-ear hearing aid (ITE device) that is composed of a customized shell introducible into the auditory passage and a prefabricated (i.e. standardized) face plate to be put in place onto the shell. Given devices of this type, the face plate is fashioned as a pre-fabricated assembly unit that carries the operating elements such as volume control, matching control and on/off switch, as well as accepting the microphone, the battery compartment and parts of the amplifier unit at its inside surface. Since the assembly unit to be introduced into the hearing aid shell is a face plate unit suitable for all dimensions occurring in the care of hearing-impaired persons, a lateral edge that is then visible at the hearing aid must be processed when connecting the face plate to the housing shell.

German PS 35 05 390 discloses an in-the-ear hearing aid whose face plate carries a cover pivotably arranged at the housing, the cover having a recess at its inside and an opening in its front wall through which an actuation button extends. This embodiment is rather complicated and additionally must include a mounting plate, push switch, etc., at the inside of the face plate. Further, undesirable, visible openings are located in the face plate.

SUMMARY OF THE INVENTION

An object of the invention is to provide a hearing aid device of the type initially described which can be inconspicuously worn in the ear, and wherein the housing shell insertable into the auditory passage is connectable to a face plate that is pre-fabricated and equippable with hearing aid components to form a function unit.

The above object is achieved in a hearing aid device according to the invention having a face plate with a closed visible surface without openings and without emplaced components. Such a face plate can be advantageously prefabricated by machine and can be manufactured of plastic as a molded or injected part. A simple prefabrication and pre-assembly are possible since the function components are not provided on the visible surface of the face plate, so that the face plate equipped with the hearing aid components forms a pre-testable hearing aid unit that can then be put in place onto the housing shell.

An anatomical adaptation to the shape of the concha is achieved due to the concave shape of the visible surface of the face plate. When a color matching to the skin type of the hearing aid wearer is additionally selected, such a hearing aid can barely be noticed.

In order to aerate the residual volume of the auditory passage in which an ITE device is disposed, the hearing aid is provided with a vent or vent channel. According to the invention, the sound admission opening to the microphone as well as a vent opening can thereby be arranged so as to be covered in the edge region of the face plate.

DESCRIPTION OF THE DRAWINGS

FIG. 1 is a diagrammatic illustration of an ITE hearing aid device of the invention, partly in section.

FIG. 2 shows a hearing aid device of the invention with a battery compartment provided in the housing and with a pivotably attached face plate that carries components arranged at the housing side.

DESCRIPTION OF THE PREFERRED EMBODIMENTS

Figure 3:
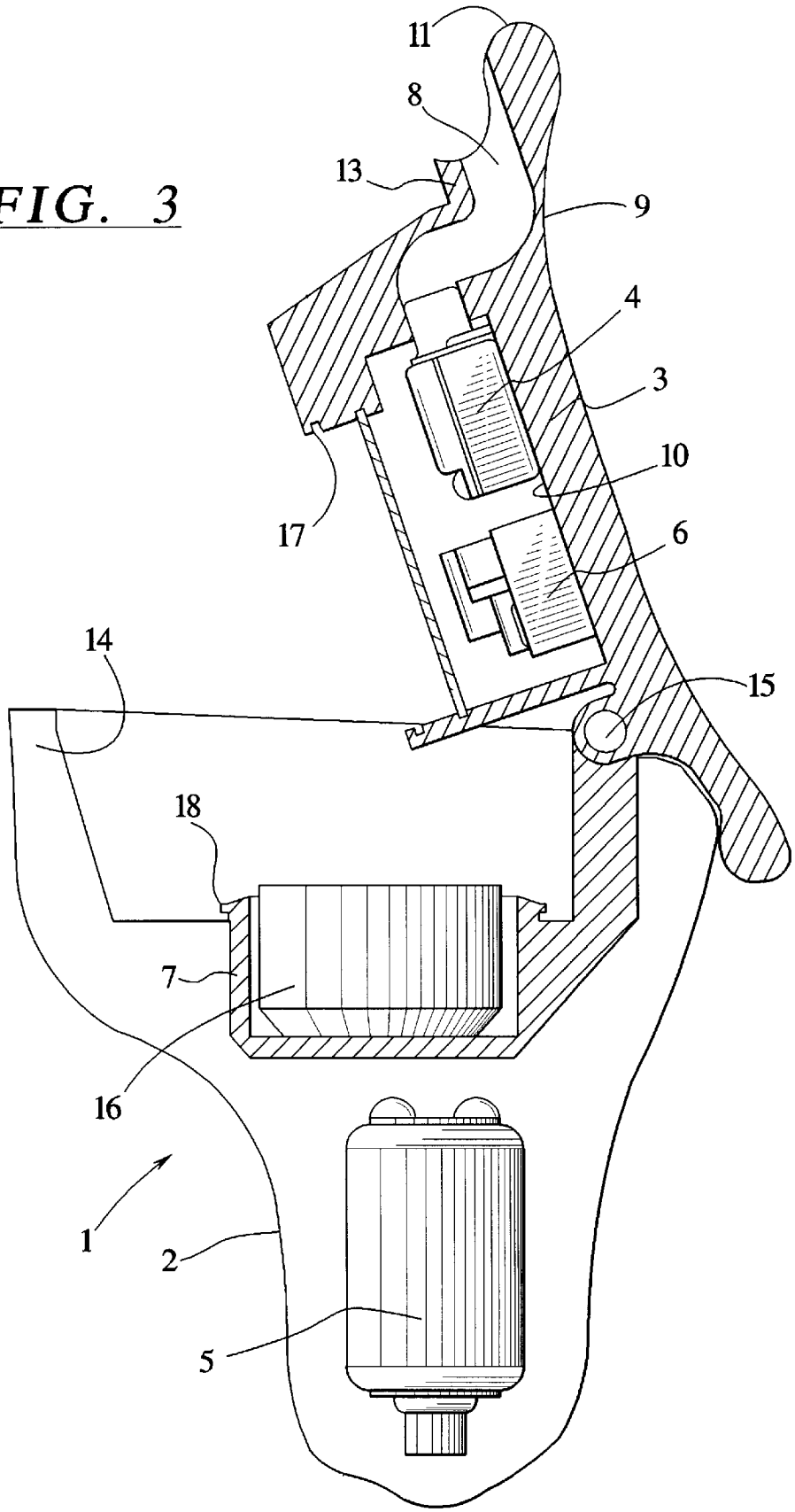
FIG. 3 shows a hearing aid device according to FIG. 2 with its face plate swivelled outwardly, for example for changing the battery.

The ITE hearing aid device 1 is composed of a housing shell 2, particularly a housing shell 2 individually fabricated (customized) with an ear impression, in whose proximal, inner housing section an earphone 5 is arranged. A face plate 3 is put in place onto the planar face of the distal, enlarged head part of the shell 2.

The face plate 3 is preferably a pre-fabricated molded or injected part of plastic and has a closed visible surface 9 that has neither passages, bores, openings or the like and that is not equipped with actuation elements, switches, controls or battery compartment flaps to be opened. For adaptation to the shape of the human concha, the visible surface 9 of the face plate 3 is concavely shaped or may have a contour more precisely based on the human concha. It is also advantageous for the visible surface of the face plate to be colored with a human skin tone. Further, the visible surface can be structured in adaptation to the skin quality.

At the housing inside surface 10 facing away from the visible surface 9, the face plate 3 is also equipped with hearing aid components 4, 6 and 7 and forms a function unit with these components. In the exemplary embodiment, the housing side of the face plate carries a microphone 4, an amplifier unit 6 and a battery compartment 7 that can be laterally opened, for example for changing a battery. A sound admission opening 8 is arranged in the edge region 11 of the face plate 3, through which acoustic signals can proceed to the allocated microphone 4. The opening 8 is arranged such that it does not appear in the visible surface 9. If it is necessary that the hearing aid device have a vent channel for aeration and for pressure equalization of the auditory passage, such a vent opening 12 is likewise arranged in the edge region 11 of the face plate 3, so as not to be externally visible.

According to the exemplary embodiment of FIGS. 2 and 3, a battery compartment 7 for a replaceable battery 16 is provided in the housing shell 2. The compartment 7 is opened and closed by the face plate 3. The face plate 3 is pivotably hinged around a hinge axis 15. In an embodiment, the face plate 3 with the attached battery compartment 7 is fashioned as a unit that can be pre-assembled and that can also be equipped with hearing aid components to form a function unit. The end-face edge section of the housing shell 2 can be provided with a shoulder to form a catch closure part 13 that is latchable to a cooperating shoulder 14 of the face plate to form a tight closure. The electrical hearing aid components are thus protected against moisture, perspiration and cerumen. A rounded edge region 11 of the face plate 3 terminates the visible surface 9, so that neither edges nor the closure between face plate 3 and shell 2 are visible. For latching the swivellable face plate 3 to the battery compartment 7, the face plate 3 may have, for example, a catch channel 17 and the battery compartment 7 than has an allocated catch nose 18.

Although various minor modifications might be suggested by those skilled in the art, it should be understood that our wish to embody within the scope of the patent warranted hereon all such modifications as reasonably and properly come with the scope of our contribution to the art.

We claim as our invention:

1. An in the ear hearing aid comprising:

a housing composed of a customized shell and a face plate attached to said shell;

a plurality of electrical hearing aid components disposed inside said housing;

said face plate having a sound admission opening therein and a completely closed externally visible surface having no openings therein and no components thereon; and said face plate having an edge region, and said sound admission opening being disposed at said edge region of said face plate and said sound admission opening being covered by said externally visible surface.

2. A hearing aid as claimed in claim 1 wherein said externally visible surface of said face plate is concave.

3. A hearing aid as claimed in claim 1 wherein said externally visible surface of said face plate has a contour matched to a human concha.

4. A hearing aid as claimed in claim 1 wherein said externally visible surface of said face plate has a color matched to a human skin tone.

5. A hearing aid as claimed in claim 1 wherein said externally visible surface of said face plate has an external structure adapted to resemble human skin.

6. A hearing aid as claimed in claim 1 wherein said face plate comprises a machine-fabricated part.

7. A hearing aid as claimed in claim 1 wherein said face plate has an internal surface facing said shell, and wherein said internal surface has at least one of said components mounted thereon, said face plate forming a functional unit with said at least one of said components.

8. A hearing aid as claimed in claim 1 further comprising at least one vent opening at said edge region of said face plate, said vent opening being covered by said externally visible surface.

9. A hearing aid as claimed in claim 1 wherein one of said hearing aid components comprises a microphone, and wherein said microphone is mounted to said face plate in audio communication with said sound admission opening.

10. A hearing aid as claimed in claim 1 wherein one of said hearing aid components is a battery, and wherein said housing contains a battery compartment for said battery, and wherein said face plate is releasably attached to said shell allowing opening of said face plate for battery replacement, and said face plate and said shell having a catch closer for maintaining said face plate tightly closed against said shell.

11. A hearing aid as claimed in claim 10 wherein said catch closer comprises a moisture-tight closure.

12. A hearing aid as claimed in claim 10 further comprising a hinge attaching said face plate to said shell allowing pivoting of said face plate relative to said shell between an open position and a closed position.

13. A hearing aid as claimed in claim 1 wherein said shell has a first internal circumferential shoulder and wherein said face plate has a second internal circumferential shoulder, said first and second shoulders mating when said face plate is closed on said shell.

* * * * *